United States Patent [19]

Plain

[11] Patent Number: 4,789,150

[45] Date of Patent: Dec. 6, 1988

[54] SHEET STACKING APPARATUS WITH TRAIL EDGE CONTROL FLAPS

[75] Inventor: Margaret C. Plain, Rochester, N.Y.

[73] Assignee: Xerox Corporation, Stamford, Conn.

[21] Appl. No.: 880,519

[22] Filed: Jun. 30, 1986

[51] Int. Cl.[4] ..... B65H 31/26

[52] U.S. Cl. ..... 271/220

[58] Field of Search ..... 271/220, 224, 182

[56] References Cited

U.S. PATENT DOCUMENTS

| | | | |
|---|---|---|---|
| 3,220,724 | 11/1965 | Von Glahn | 271/68 |
| 3,848,992 | 11/1974 | Smith | 355/15 |
| 3,957,264 | 5/1976 | Bach et al. | 271/182 X |
| 4,056,264 | 11/1977 | Dhooge et al. | 271/177 |
| 4,340,213 | 7/1982 | Jensen | 271/219 |
| 4,406,449 | 9/1983 | Buck | 271/220 |
| 4,441,702 | 4/1984 | Nagel et al. | 271/177 |
| 4,469,319 | 9/1984 | Robb et al. | 271/3.1 |

FOREIGN PATENT DOCUMENTS

| | | | |
|---|---|---|---|
| 0232367 | 11/1985 | Japan | 271/220 |
| 789015 | 1/1958 | United Kingdom | 271/220 |
| 1561965 | 3/1980 | United Kingdom | 271/220 |

OTHER PUBLICATIONS

Xerox Disclosure Journal—vol. 6, No. 5, Sept./Oct. 1981, pp. 237–238.

Xerox Disclosure Journal—vol. 10 No. 5, Sept./Oct. 1985, p. 273.

*Primary Examiner*—Joseph J. Rolla

*Assistant Examiner*—David H. Bollinger

*Attorney, Agent, or Firm*—William A. Henry, II

[57] ABSTRACT

A sheet stacking apparatus for use with throughput from high speed copiers or printers includes dual independently acting control flaps that provide positive control of sheets being stacked in the apparatus by controlling the trail edges as well as the entire sheets as they are fed into a catch tray.

13 Claims, 3 Drawing Sheets

SHEET STACKING APPARATUS WITH TRAIL EDGE CONTROL FLAPS

BACKGROUND OF THE INVENTION

This invention relates to copy sheet stacking systems for copiers or printers, and more particularly, relates to a sheet stack apparatus that enables handling of throughput from high speed machines of any kind.

As xerographic copiers and printers of all kinds increase in speed, and use state of the art recirculating document handlers, it is increasingly important to provide copy sheet output devices that can reliably stack copy sheet output from such machines. At present, some machines feed copy sheets to stacking trays at such high rates that jams are caused in the trays because preceding sheets do not have time to settle to the bottom of the stacking tray before succeeding sheets are forced into the trays by the transport systems of the machines. Also, the trail edge of preceding sheets sometimes are lifted up and out of the stacking tray by the lead edges of incoming sheets because of a small intercopy sheet gap.

PRIOR ART

Various approaches have been tried toward controlling sheets as they enter a catch tray. For example, U.S. Pat. No. 4,469,319 discloses an apparatus that provides automatically variable corrugation stacking means for handling large flimsy sheets coming into a tray. A guide is provided adjacent an input roller that drives sheets into a stack tray in U.S. Pat. No. 4,056,264. U.S. Pat. No. 3,220,724 shows a sheet stacking device that includes a stationary feed guide which has an upright rail for guiding sheets to be stacked edge stacked. A print stacking apparatus with a print deflecting flap is disclosed in U.S. Pat. No. 4,340,213. The print deflecting flap insures that even an extremely curled print cannot rise over a top portion of a stop member. A device for collecting and stacking photographic prints is shown in U.S. Pat. No. 4,441,702 in which is included a spring biased press pad arranged downwardly in the feeding path and positioned after rollers that feed prints into a container. The Xerox Disclosure Journal, Vol. 10, Number 5, September/October, 1985, page 273 discloses copy control flaps used to control the stacking of copy sheets fed into a catch tray from a photocopying machine. A spring loaded sheet deflector used to assist in the restacking of different thicknesses (weights) of document sheets in a recirculating document handler is disclosed in the Xerox Disclosure Journal, Vol. 6, Number 5, September/October, 1981, page 238. U.S. Pat. No. 3,848,992 shows the use of doctor blade with a spring attached to it for cleaning toner from the surface of a photoconductive member.

The present invention desirably overcomes or reduces various of the problems or limitations discussed above and/or in the cited references.

SUMMARY OF THE INVENTION

Accordingly, a sheet stacking device capable of handling high throughput from copiers or printers or the like is disclosed and includes sheet output means, a tray having a surface for receiving sheets from said sheet output means and multiple independently acting sheet biasing means, said multiple independently acting sheet biasing means including an elongated flexible member that overlies sheets entering the tray and a short flexible member that is adapted to immediately remove the trail edges of sheets exiting said output means from the exit path of the output means.

BRIEF DESCRIPTION OF THE DRAWINGS

Various of the above-mentioned and further features and advantages will be apparent from the example described hereinbelow of specific apparatus and steps of operation. The invention will be better understood by reference to the following description of one specific embodiment thereof, which includes the following drawing figures (approximately to scale) wherein.

DESCRIPTION OF THE PREFERRED EMBODIMENTS

Figure 1:
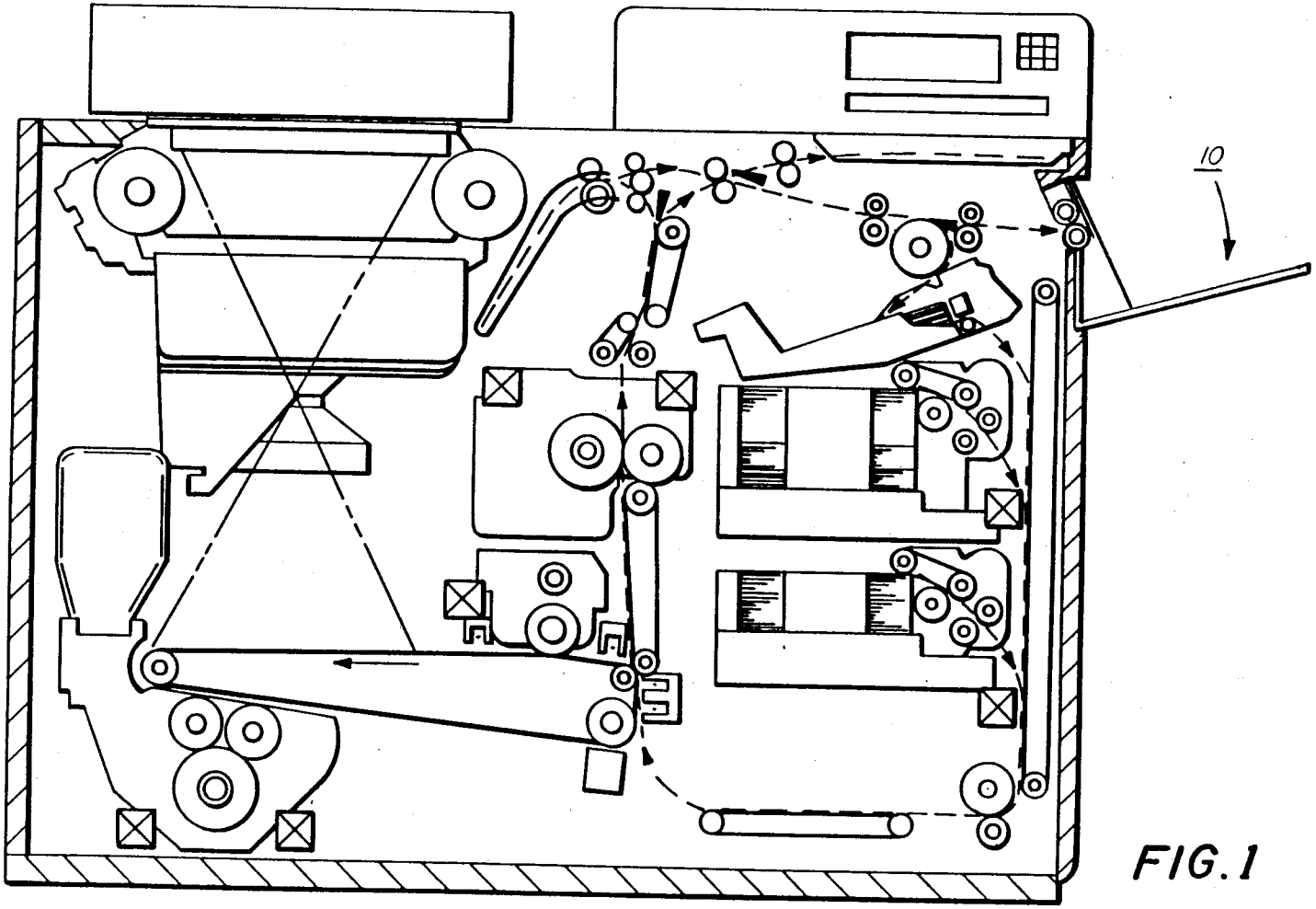
FIG. 1 is a side view of an exemplary copier with a schematic sheet output stack tray, showing a modification of the output for copy sheets thereof in accordance with one example of the present invention.

The copier disclosed herein in FIG. 1, by way of one example, is otherwise conventional and corresponds to the Xerox Corporation "1075" copier. Only the copy sheet output means and tray is modified. It is shown with one example of a modification thereof to incorporate an example of the present invention. Further details of this exemplary copier and its document recirculating apparatus per se are disclosed in U.S. Pat. No. 4,278,344 issued July 14, 1981 to Ravi B. Sahay. Further details of control for this exemplary copier are disclosed in the following pending U.S. patent applications and foreign equivalents thereof: Ser. Nos. 420,965; 420,933 and 421,006, all filed Sept. 21, 1982.

Examples of various other patents generally teaching known document handlers and copiers and control systems therefor, including document and paper path switches and counters, are U.S. Pat. Nos.: 4,054,380; 4,062,061; 4,076,408; 4,078,787; 4,099,860; 4,125,325; 4,132,401; 4,144,550; 4,158,500; 4,176,945; 4,179,215; 4,229,101 4,278,344; 4,284,270 and 4,335,949. Conventional simple software instructions in a copier's conventional microprocessor logic circuitry and software of document handler and copier control functions and logic, as taught by the above, and other patents and various commercial copiers, are well known and preferred. However, it will be appreciated that the functions and controls described herein may be alternatively conventionally incorporated into a copier utilizing any other suitable or known simple software or hard wired logic systems, switch controllers, etc. Suitable software for functions illustrated or described herein may vary depending on the particular microprocessor or microcomputer system utilized, of course, but will be already available to or readily programmable by those skilled in the art without experimentation from the descriptions and references provided herein.

The control of exemplary document and copy sheet handling systems may be accomplished by conventionally actuating them by signals from the controller directly or indirectly in response to simple programmed commands and from selected actuation or non-actuation of conventional copier switch inputs by the copier operator, such as switches selecting the number of copies to be made in that run, selecting simplex or duplex copying, selecting whether the documents are simplex or duplex, selecting a copy sheet supply tray, etc. The resultant controller signals may conventionally actuate various conventional electrical solenoid or cam controlled sheet deflector fingers, motors or clutches in the copier in the selected steps or sequences as programmed. Conventional sheet path sensors, switches and bail bars, connected to the controller, may be utilized for sensing and timing the positions of documents and copy sheets, as is well known in the art, and taught in the above and other patents and products. Copying systems utilize such conventional microprocessor control circuitry with such connecting switches and sensors for counting and comparing the numbers of document and copy sheets as they are fed and circulated, keeping track of their positions, counting the number of completed document set circulations and completed copies, etc., and thereby controlling the operation of the document and copy sheet feeders and inverters, etc.

All references cited herein, and their references are incorporated by reference herein for appropriate teachings of additional or alternative details, features, and/or technical background.

A preferred specific feature disclosed in this specification is to provide a finishing device that provides positive control of sheets being stacked in the device. Such a device is shown in FIGS. 2A–2D where a simple, double flap 30 and 40 controls both the trail and other major portions as well as have some effect on the entire sheet 16 as each sheet is fed into catch tray 20 and onto an output stack 18. The flaps act cooperatively to guide the trail edge and the entire sheet down onto the stack. The flaps prevent trail edge flapping and perturbations of the sheet motion. Also, the dual flaps allow sheets to be fed in tighter timing schemes since only a controlled setting time need to be allowed. The stacker is less costly than other stackers because no elevator is required if dual flaps are used to press sheets down onto a sheet stack supported by a catch tray platform or support surface. The device of the present invention could also be used to efficiently stack individual sets of copy sheets.

Figure 2A:
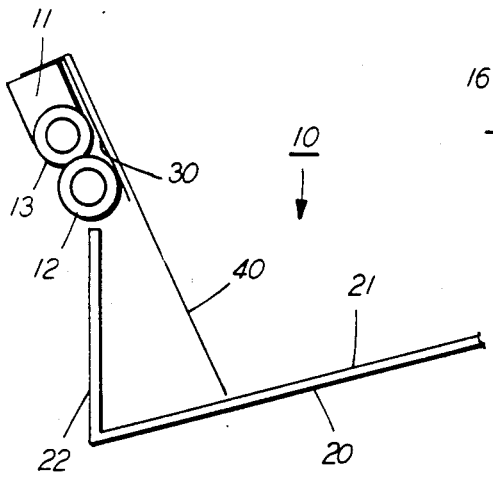
FIGS. 2A–2D are partial schematic side views of the sheet stacking apparatus of the present invention shown receiving and stacking an individual sheet.

In particular reference to FIG. 2A, catch tray 20 is shown with an inclined support surface 21 that also serves with gravity to help register sheets against wall 22 that is at an acute angle in relation support surface 21. Support brackets 11 are mounted to the copier frame and support idler rollers 13 that are driven by drive rollers 12. Shafts 14 and 15 rotatably support rollers 12 and 13, respectively. Drive rollers 12 and idler rollers 13 comprise sheet output means for transporting copy sheets from the copier to catch or sheet stacking tray 20 and are preferably corrugation rollers. Brackets 11 also support multiple composite independently acting sheet biasing means 30 and 40 that include elongated flexible members 40 that overlie sheets entering tray 20 and short flexible members 30 that are adapted to immediately remove the trail edges of sheets exiting the output rollers 12 and 13 from the exit path of the output rollers so that all incoming sheets can enter the tray without interference or obstruction from other sheets that have already exited the output rollers. Elongated flaps 40 also serve to force the entire sheet down away from the output rollers.

Figure 2B:
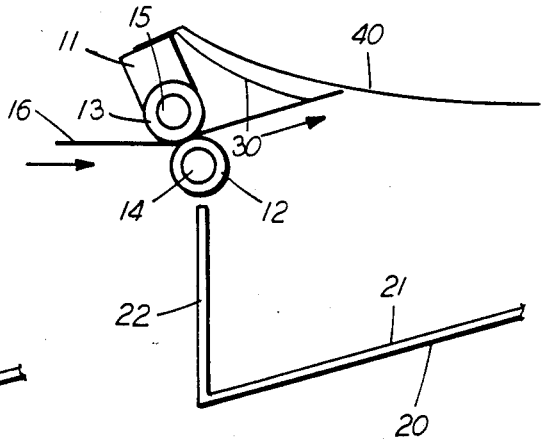
Figure 2C:
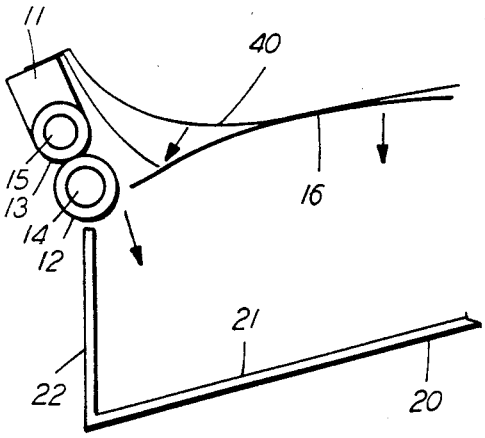
Figure 2D:
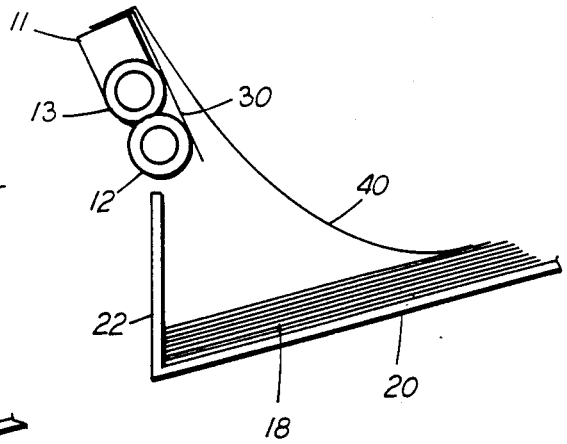

The composite double flap configuration of the sheet edge control means of the instant invention serves two functions: aerodynamic disturbances and sheet flutter are reduced, enabling sheets stacking up to 500 sheets of B5 - A3 16# - 110# paper without the need of an elevator by controlling the path of copy sheets, which minimizes misregistration. The flaps also eliminate the need for side guides and front wall adjustments (front wall can be eliminated entirely); and the flaps reduce process timing requirements, enabling easy handling of sheets up to approximately 137 copies per minute or more. Both flaps 30 and 40 remain adjacent to the output rollers 12 and 13 (FIG. 2A) until they are deflected by a corrugated sheet 16 coming through the output nip formed between rollers 12 and 13 as seen in FIG. 2B. After the sheet exits the corrugation nip, the trail edge control flap 30 returns to its initial position thereby ecouraging the trail edge of the sheet as shown in FIG. 2C to descend past the output nip. This action of control flap 30 decreases the settling time of the sheet while at the same time allowing a second sheet to exit the output nip without interference or causing a jam. Long flap 40 shown in FIG. 2D in its return motion from being deflected by sheet 16, guides the sheet onto the copy sheet stack after its release from the output nip. The flap is especially effective at positioning the first two hundred or so copies of a five hundred copy run into a deep tray 20.

It is preferable to use Mylar control flaps, but other flaps will perform the desired function also, e.g. plasticized polyvinylchloride (PVC) could be used. Thickness and width dimensions require that they be flexible enough not to alter the angle of the exiting sheet, yet stiff enough to control the sheet's trail edge and push it past the output roller nip and return it to its initial position quickly. For example, it was found that double Mylar flaps, 20 mm wide, 0.0075" thick, 60 mm and 100 mm long provide the best registration results for 500 sheet sets at 137 cpm. For best stacking results, the long flap should just touch the bottom surface of the tray with the short flap positioned immediately adjacent and parallel to the output rollers. This copy sheet stacking apparatus could also be used for knocking down copy sheet sets instead of individual copy sheets.

Figure 3:
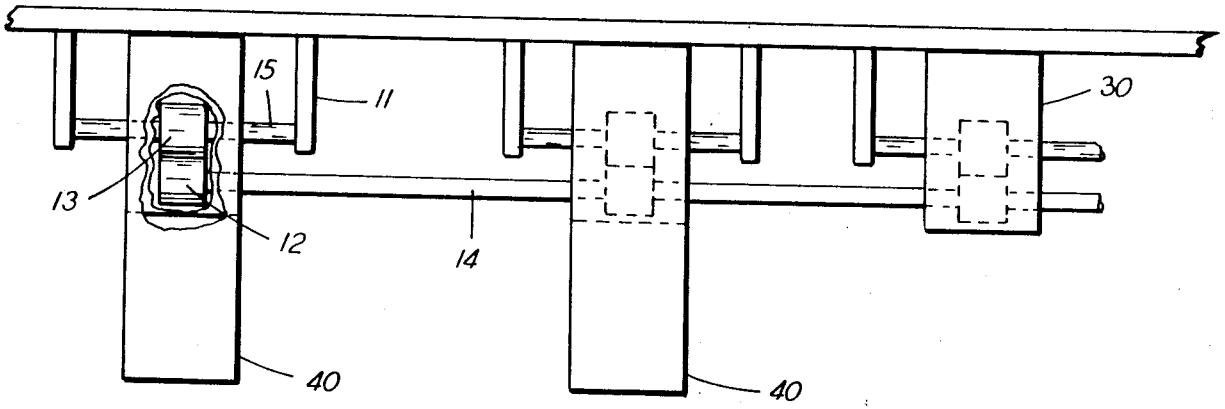
FIG. 3 is a partial schematic of an alternative embodiment of the apparatus of the instant invention as viewed from the right end of the copier of FIG. 1.

In FIG. 3, an alternative embodiment of the present invention is shown that includes a plurality of double flaps 30, 40 with separate and independent flap 30 mounted adjacent but removed from the double flaps. This single flap gives better control of the trail edge of a sheet across the width of the sheet.

In conclusion, a copy sheet stacking apparatus is disclosed that improves misregistration of sheets within a stacking tray while eliminating jams within the tray. The sheet stacking apparatus includes a plurality of dual flaps positioned adjacent copy sheet output means with the flaps superimposed one on the other with one of the flaps being short and the other elongated. The elongated flap is effective near the bottom of the tray when 500 sheets are being stacked since it guides the sheets as they settle to the bottom of the tray. The short flap encourages the sheet's trail edges down out of the exit path of the sheet output rollers, thus decreasing fluttering of the sheets and the required settling time.

What is claimed is:

1. A copy sheet stacking apparatus that provides positive control of sheets being stacked in the apparatus, comprising sheet output means, a tray having a surface for receiving sheets from said sheet output means and multiple independently acting sheet biasing means positioned downstream of and in interfering relation with sheets leaving said sheet output means and overlying and immediately downstream of the entrance to said tray, said multiple independently acting sheet biasing means each includes an elongated flexible member that overlies sheets entering the tray and a short flexible member that is adapted to immediately remove the trail edges of sheets exiting the output means from the exit path of the output means in such a manner that sheets entering the tray initially deflect both said elongated and short flexible members simultaneously.

2. The copy sheet stacking apparatus of claim 1, wherein said multiple independently acting biasing means comprises composite flexible double flaps which control both the trail edge and remaining portions of a sheet as it is fed into the tray.

3. The copy sheet stacking apparatus of claim 2, wherein said double flaps are mounted in superposed relation.

4. The copy sheet stacking apparatus of claim 3, including at least one short flexible member that acts on sheets entering the tray separate and independent from said double flaps.

5. The copy sheet stacking apparatus of claim 1, wherein said multiple independently acting biasing means comprises at least two sets of superposed dual elongated and short flexible members and at least one separate and independent short flexible member.

6. The copy sheet stacking apparatus of claim 1, wherein subsequent movement of copy sheets into the tray after said initial deflection of both of said elongated and short members causes only said elongated flexible member to continue deflecting.

7. The copy sheet stacking apparatus of claim 6, wherein said short flexible member deflects trail ends of copy sheets while said elongated flexible member deflects the trail ends of copy sheets as well as other major portions of the copy sheets.

8. In a copier with a copy sheet stacking apparatus for stacking copy sheets exiting the copier at high throughput, the improvement wherein said copy sheet stacking apparatus provides positive control of sheets being stacked therein by including, a tray having a surface for receiving sheets from the copier and multiple independently acting sheet biasing means positioned overlying and immediately downstream of the entrance to said tray, said multiple independently acting sheet biasing means each includes a composite member having at least one elongated flexible member that overlies sheets entering the tray and at least one short flexible member that is adapted and positioned to interfere with sheets entering the tray in order to immediately remove the trail edges of sheets exiting the copier from the sheet exit path of the copier to thereby eliminate any possible interference of sheets already in the tray with succeeding sheets entering the tray, and wherein sheets entering the tray initially deflect both said elongated and short flexible members simultaneously.

9. The improvement of claim 8, wherein said a least one elongated flexible member is adapted to guide entire sheets down into the tray and said at least one short flexible member is adapted to press trail edges of sheets down into the tray.

10. The improvement of claim 8, including at least one short flexible member that is separate and independent from said at least one superposed elongated and short flexible members.

11. A copy sheet stacking apparatus that provides positive control of sheets being stacked in the apparatus, comprising, a tray having a surface for receiving sheets from a source and multiple independently acting sheet biasing means positioned overlying and immediately downstream of the entrance to said tray, said multiple independently acting sheet biasing means each includes a composite member having an elongated flexible member that overlies sheets entering the tray and a short flexible member that is adapted and positioned to interfere with sheets entering the tray in order to immediately remove the trail edges of sheets exiting said source from the exit path of said source, and wherein sheets entering the tray initially deflect both said elongated and short flexible members simultaneously.

12. The copy sheet stacking apparatus of claim 11, wherein copy sheets fed from said source to said tray are in sets.

13. A copy sheet stacking apparatus that provides positive control of sheets being stacked in the apparatus, comprising at least one pair of sheet output rollers, a tray having a surface for receiving sheets from said at least one pair of sheet output rollers and multiple independently acting sheet biasing means positioned downstream of and in interfering relation with sheets exiting said at least one pair of sheet output rollers and overlying and immediately downstream of the entrance to said tray, said multiple independently acting sheet biasing means each includes an elongated flexible member that overlies sheets entering the tray and a short flexible member that is in contact with said at least one pair of sheet output rollers and is adapted to immediately remove the trail edges of sheets exiting said at least one pair of sheet output rollers from the exit path of said at least one pair of sheet output rollers.

* * * * *